United States Patent [19]

Bartholomäus

[11] Patent Number: 4,699,571

[45] Date of Patent: Oct. 13, 1987

[54] CONTROL VALVE FOR A VARIABLE DISPLACEMENT PUMP

[75] Inventor: Reiner Bartholomäus, Neuendorf, Fed. Rep. of Germany

[73] Assignee: Mannesmann Rexroth GmbH, Lohr, Fed. Rep. of Germany

[21] Appl. No.: 781,527

[22] Filed: Sep. 30, 1985

[30] Foreign Application Priority Data

Nov. 28, 1984 [DE] Fed. Rep. of Germany ..... 3443265

[51] Int. Cl.[4] ..... F04B 49/00

[52] U.S. Cl. ..... 417/213; 417/218

[58] Field of Search ..... 417/213, 218–222; 60/452, 450

[56] References Cited

U.S. PATENT DOCUMENTS

| | | | |
|---|---|---|---|
| 3,720,483 | 3/1973 | Hayner et al. | 417/307 X |
| 3,768,928 | 10/1973 | Miller et al. | 417/213 |
| 3,820,920 | 6/1974 | Klimaszewski et al. | 417/213 |
| 3,969,038 | 7/1976 | Nonnenmacher et al. | 417/218 |
| 4,142,841 | 3/1979 | Claar et al. | 417/213 |
| 4,432,703 | 2/1984 | Beutler et al. | 417/218 X |
| 4,468,173 | 8/1984 | Dantlgraber | 417/220 |
| 4,527,958 | 7/1985 | Borman | 417/213 X |

FOREIGN PATENT DOCUMENTS

| | | | |
|---|---|---|---|
| 65304 | 11/1982 | European Pat. Off. | 60/450 |
| 2139362 | 2/1973 | Fed. Rep. of Germany | 417/221 |
| 2363480 | 6/1975 | Fed. Rep. of Germany | 417/221 |
| 3016609 | 11/1981 | Fed. Rep. of Germany | 417/220 |
| 3118576 | 12/1982 | Fed. Rep. of Germany | 417/218 |

OTHER PUBLICATIONS

Rexroth Publication: Title page and pp. 18, 66, 70–72, final page.

*Primary Examiner*—Carlton R. Croyle
*Assistant Examiner*—Paul F. Neils
*Attorney, Agent, or Firm*—Harness, Dickey & Pierce

[57] ABSTRACT

In the pressure regulation of a variable displacement pump very high pressures can build up in the pump delivery line if at the consumer no discharge of the fluid takes place, for example the piston of a servo motor moves against a stop. A pressure regulation of the pump is then only possible via the inner losses of the pump. Consequently, although the pressure can be built up rapidly it can only be reduced very slowly. According to the invention the pressure reduction is via a bypass which is controlled by the control valve of the variable displacement pump and which connects the pressure side of the pump to a tank discharge when the control valve is driven in the sense of a reduction of the pump pressure. According to the invention a very rapid pressure reduction is obtained so that the variable displacement pump can again be pressure controlled.

19 Claims, 5 Drawing Figures

CONTROL VALVE FOR A VARIABLE DISPLACEMENT PUMP

DESCRIPTION

Figure 1:
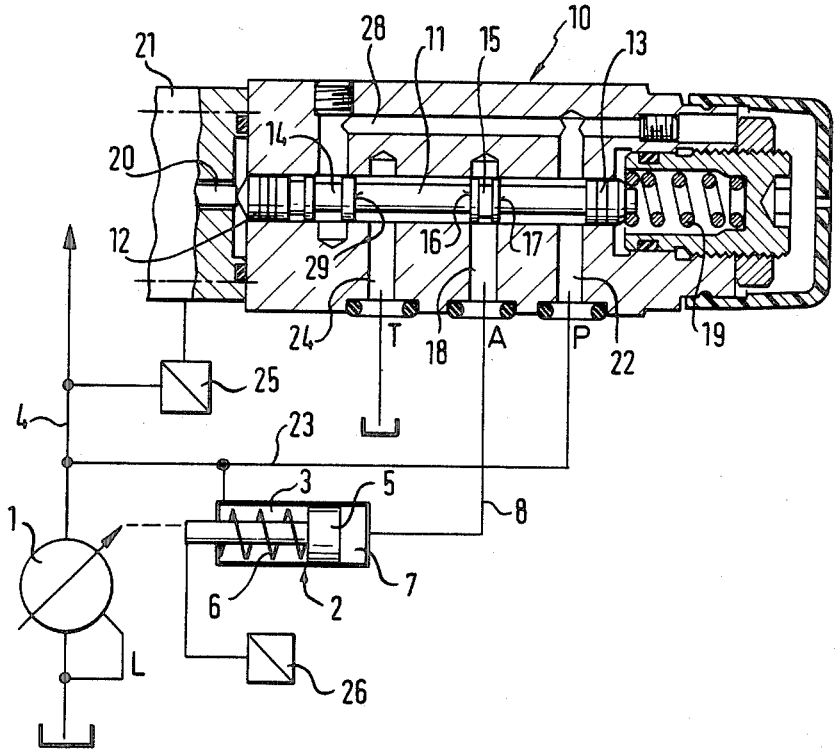

The invention relates to a control valve for a variable displacement pump having the features set forth in the preamble of claim 1.

The proportional magnet of the known control valve (P 3016 609) from which the invention proceeds is driven by the output signal of a control amplifier whose input receives a signal depending on the pressure in the pump pressure line. The variable displacement pump is thus regulated in dependence upon the pressure. In certain uses, when for example the piston of a servo motor connected to the pump pressure line moves against a stop or for example a high retaining pressure is to be generated by the closure cylinder of a plastic processing machine, the variable displacement pump not only generates the pressure necessary for this purpose but in addition the fluid in the pressure line between variable displacement pump and consumer is compressed. The adjustment means of the pump has regulated the displacement volume to a very low value or zero so that the pump is at minimum pivot angle. The compression volume enclosed in the line can then only be diminished via the leakage oil gradually flowing from the system in known manner, in particular of the pump. However, before the pressure has been diminished the pump cannot be regulated by the adjustment means to a new lower pressure.

The problem underlying the invention resides in diminishing as rapidly as possible the pump pressure building up in the pump pressure line to enable the adjustment means of the pump to start operating again.

This problem is solved according to the invention by the features set forth in the characterizing clause of claim 1.

Thus, if the high pressure has built up in the pressure line with minimum displacement setting of the pump and thereafter the control valve is actuated in the sense of a pressure reduction in the pump pressure line, the control valve is switched so that a bypass between the pressure side of the pump and a discharge passage to the tank is bridged, via which the pressure decrease can take place very rapidly and automatically, whereupon the pressure regulation of the pump starts again.

Advantageous further developments of the invention are set forth in the subsidiary claims. Thus, it is in particular advantageous if proceeding from the normal control position of the control valve for pressure regulation of the variable displacement pump in which the control space of the adjusting means for the pump is connected selectively to the pressure connection or the tank connection, the proportional magnet is driven with a signal whose magnitude differs substantially from the signal necessary for the control position so that opening of the bypass line in the control position is avoided, since this line is not to be opened until the pressure reduction from the very high pressure to a lower pressure is desired.

In an axial piston pump for setting the pump to a smaller pressure value and diminishing the high pressure in the pressure line the control space facing the larger piston area of the adjusting piston is connected to the pressure connection so that during the pressure reduction the pivot angle of the pump is further retained at a minimum value and consequently during the pressure reduction the pump does not convey any appreciable amount of fluid to the pressure line. The pressure reduction takes place up to the lower pressure in the pressure line predetermined by a desired value. When this is reached the proportional magnet of the control valve is driven so that the control valve returns to the normal control position.

The fluid connection between the pressure connection and the tank connection for reducing the high pressure can also be established in different manner. Thus, the control valve itself can via a special piston section control the connection of a bypass line to the tank connection. The control valve can however also be alternatively constructed so that as a pilot valve it controls the fluid path between the pressure connection and the tank connection for the pressure reduction which is provided in a routing valve attached to the control valve. This provides a more rapid pressure reduction. The routing valve can be constructed with a piston or also as a seat valve with a ball.

The examples of embodiment are described with reference to a system in which the pump is illustrated as axial piston pump. The control valve according to the invention may however also be used in other variable displacement pumps such as vane pumps when the latter are pressure-regulated and very high pressures can arise in the pressure line of the pump. In a variable displacement pump with a lift ring displaceable oppositely by two pistons the connections of the control valve must be provided accordingly.

Figure 2:
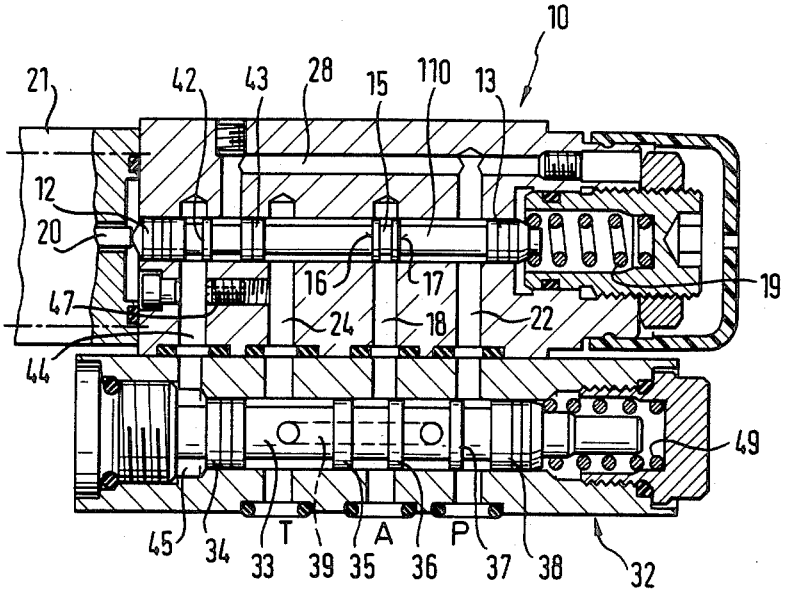
Figure 3:
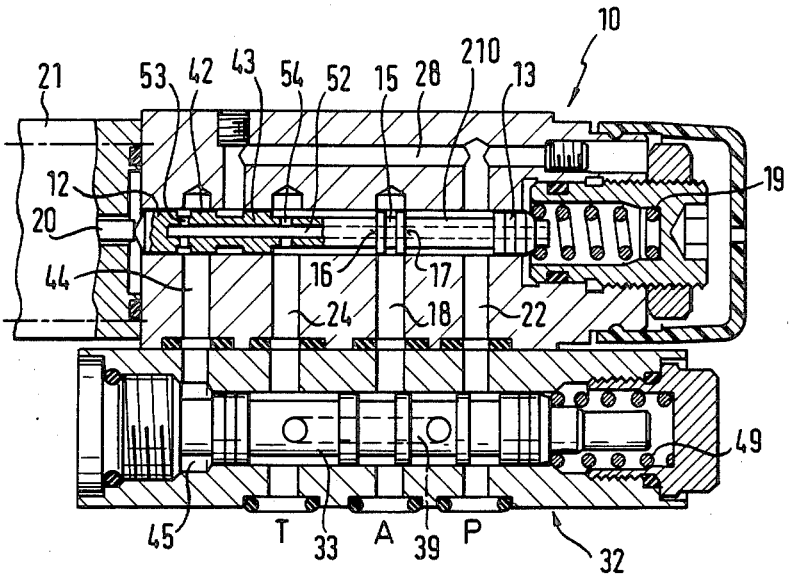
Figure 4:
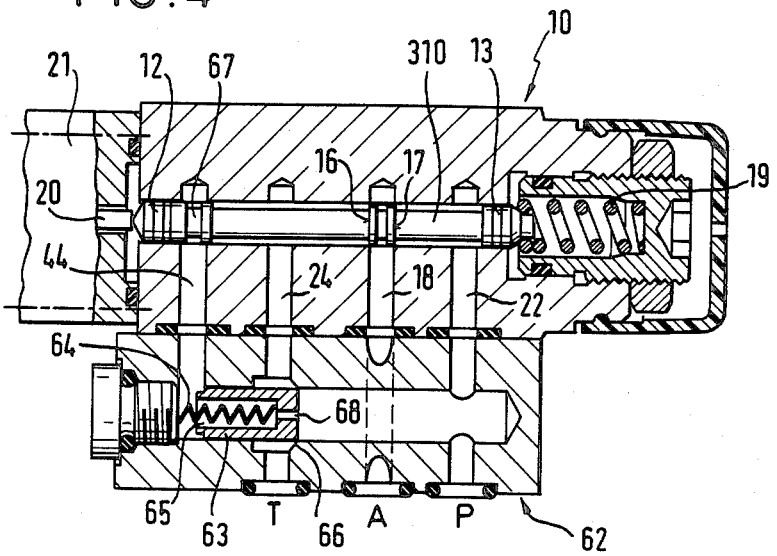
Figure 5:
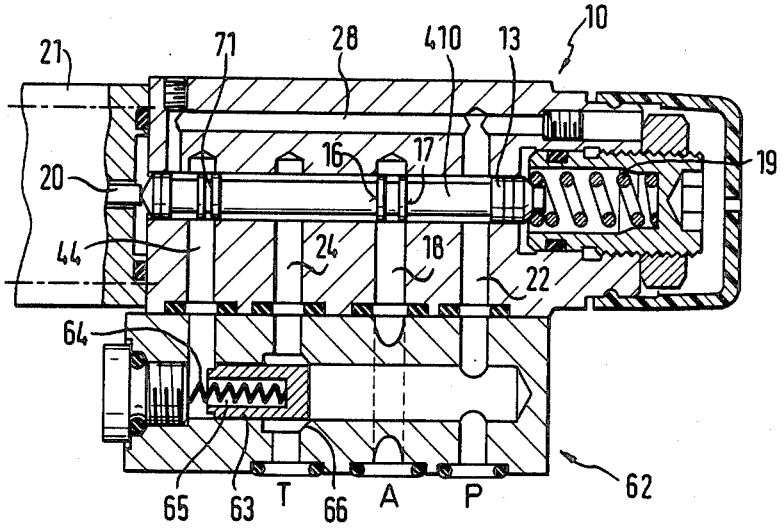

Examples of embodiment of the invention will be explained in detail hereinafter with the aid of the drawings, wherein:

FIG. 1 is a section through a control valve having a direct-controlled bypass and a schematic illustration of an adjustment, FIG. 2 is a section through a routing valve with piston pilot-controlled by the control valve, FIG. 3 is a section similar to FIG. 2 with a modified pilot control, FIG. 4 is a section through a routing valve with ball pilot-controlled by a control valve and FIG. 5 is a section similar to FIG. 4 of a modified embodiment.

FIG. 1 shows an axial piston pump 1 whose displacement is adjustable by a hydraulic servo motor 2. The piston-rod-side space 3 of the servo motor is connected to the pump delivery line 4. The pump pressure thus acts on the smaller surface of the piston 5. A pressure spring 6 holds the pump in the starting state, i.e. when no pressure is present in the delivery line 4 at the greatest pivot angle and thus at the greatest displacement. A piston-side control space 7 is connected via a control line 8 to a connection A of a control valve 10. The control pressure thus acts on the greater piston surface of the servo motor 2.

The control valve 10 comprises a control piston 11 at the two ends of which piston portions 12 and 13 are provided between which the piston portions 14 and 15 are disposed. The piston portion 15 comprises two oppositely disposed control edges 16 and 17 which cooperate with the control passage 18 connected to the control line 8.

The control piston 11 is clamped between a pressure spring 19 and a push rod 20 of a proportional magnet 21 whose magnet winding and armature are not shown. A pressure line 23 connected to the delivery line 4 leads to the connection P of the control valve whilst a discharge passage 24 is connected to a tank.

If from the centre position illustrated in FIG. 1 by increasing the current supplied to the porportional magnet 21 the control piston 11 is moved to the right against the force of the spring 19, the control edge 16 opens the fluid path from the control line 8 to the discharge passage 24 so that the control space 7 is relieved of pressure. If on the other hand the energizing current is diminished the pressure spring 19 displaces the control piston 11 to the left and the fluid path from the pressure connection P to the control line 8 and thus to the control space 7 is released by the control edge 17.

The pressure in the delivery line 4 is detected by a pressure pickup 25 and an electrical signal is generated which is proportional to the pressure and which is supplied to a control amplifier whose output signal drives the proportional magnet 21. In the embodiment illustrated the proportional valve has no feedback for the position of the control piston or for the control pressure. The actual value for the control amplifier (not illustrated) can be picked up by an inductive travel pickup 26 whose output signal is supplied to the control amplifier and is responsive to the pivot angle of the pump.

If therefore the fluid path from the connection A to the tank T is opened fluid can flow from the control space 7 and the pump is set by the pressure in the pump pressure line 4 to a greater pivot angle and thus to a greater displacement volume. If the actual value measured in the path pickup 26 is the same as the desired value set at the control amplifier the control piston 11 is returned by the proportional magnet 21 to the starting position illustrated again in which the control edges 16 and 17 block off the control connection A and the desired pressure value is reached.

If the desired value for the delivery of the pump is reduced the control piston 11 opens at the control edge 17 the connection between the pressure connection P and the control connection A so that fluid flows into the control space 7 and the pivot angle of the pump and thus its displacement is reduced until the predetermined desired value is reached.

To this extent the control of the variable displacement pump by means of a control valve is known (P 30 16 609.7). In FIG. 1 as variable displacement pump an axial piston pump is illustrated. The same applies accordingly to a radial piston pump or a vane pump, the connections of the adjustment pistons possibly having to be interchanged accordingly.

If the pressure of a consumer (not illustrated) and connected to the pump pressure line 4 rises greatly the pressure in the control space 7 is increased to such an extent that the pump is at minimum pivot angle to produce the necessary pressure. This is for example the case in the mould closure cylinder of a plastic processing machine when at the end of the stroke the piston meets a stop and thus the pressure rises very rapidly and a very high closure pressure is generated. The fluid at high pressure enclosed in the line 4 leading to the consumer prevents returning the pump in the direction towards smaller pressures and can only be reduced via the leakage oil in the hydraulic system, i.e. via the leakage connection L of the variable displacement pump and via the leakage oil in the control valve 11 flowing to the tank. To permit a rapid response of the pump to a new lower desired value for the pressure after the pressure reduction in the line 4 a bypass passage 28 is provided in the control valve 11 which connects the pressure connection P to the tank connection T when the piston portion 14 opens the fluid path. This is the case when the control piston 11 is displaced to the left so that the pressure connection P is connected to the control line 8. The ratio of the control edge 29 of the piston portion 14 to the control edges 16 and 17 is such that the connection from the pressure connection P to the tank via the control edge 29 opens when the magnet current is reduced by about 50%, i.e. in the control position of the control edges 16 and 17 for pressure regulation in the control space 7 the connection via the control edge 29 to the tank remains closed. Only when the control piston 11 has moved a greater distance from the control position, i.e. for example the magnet current has been reduced by 50%, does the control edge 29 open and the pressure in the pump pressure line 4 can thus be reduced via the bypass line 28 to the tank. A rapid pressure reduction takes place whereupon the pressure regulation of the variable pump can take place again in the usual manner.

In the example of embodiment according to FIG. 2 in which the same components are provided with the same reference numerals in addition to the control valve 10 a routing valve 32 is provided which is formed as disc valve, i.e. as disc between the passages 18, 22 and 24 and the fluid connections A, P and T. Irrespective of the position of the slide 33 of the routing valve 32 the connection from the fluid connections A, P and T to the corresponding passages 18, 22 and 24 can be kept open. The slide 33 comprises the piston portions 34 to 38 which separate the individual fluid connections from each other. The space between the piston portions 34 and 35 is connected to the space between the piston portions 36 and 37 via a passage 39 in the piston 33.

Instead of the piston portion 29 of the control piston illustrated in FIG. 1 the control piston 110 in FIG. 2 is provided with a piston portion 42 and 43, of which the portion 43 terminates the connection between the bypass line 28 and the discharge passage 24 to the tank and the piston portion 42 controls the connection between the bypass line 28 and a control passage 44 which opens into the end space 45 of the routing valve 32. Via a nozzle 47 the control passage 44 is connected with the discharge passage 24 to the tank T so that in the illustrated position the end space 45 is pressureless.

If for reducing the high pressure in the pump delivery line 4 the control valve 10 is driven in the manner already explained, via the piston portion 42 the bypass line 28 is connected via the control passage 44 to the end space 45 and thus the piston 33 is loaded with the high pressure on the pump pressure side. The piston 33 moves against the force of a spring 49 to the right and via the piston portion 37 the fluid path from the pressure connection P via the passage 39 in the piston 33 to the tank connection T is freed. Via said fluid path the high pressure in the pump delivery line 4 is reduced.

Thus, in FIG. 2 the routing valve 32 is pilot-controlled by the control valve 10. By selecting appropriately large cross-sections for the routing valve 32 it is thus possible to obtain substantially more rapid pressure reduction compared with the construction of FIG. 1.

The piston 32 of the routing valve thereafter returns again to its starting position when via the nozzle 47 the pressure in the end space 45 is reduced towards the tank discharge 24. The control piston 110 is then again in the control position in which the connection between the bypass line 28 and the control passage 44 is shut off by the piston portion 42 and the control of the servo motor 2 of the variable displacement pump is by the control edges 16 and 17 of the control piston 110.

FIG. 3 illustrates an embodiment similar to FIG. 2, the nozzle 47 being omitted and the control piston having a passage 52 which via radial bores 53 and 54 connects the end space 45 via the control passage 44 to the discharge passage 24 to render the end space 45 pressureless.

If the high pressure in the pump delivery line 4 is to be reduced by corresponding driving of the proportional magnet 21 the control piston 210 is displaced, the piston portion 42 of which connects the bypass line 28 to the control passage 44, the piston portion 42 also shutting off the connection of the control passage 44 via the inner passage 52 to the tank discharge. Thus, the control space 45 can be subjected to the high pressure from the pressure connection P, the piston 33 switches in the manner described and to relieve the pressure connects the fluid connection P via the passage 39 to the tank connection T. The embodiment according to FIG. 3 has the advantage that the control piston 210 switches more rapidly than the control piston 110 in FIG. 2.

In the embodiment according to FIG. 4 the routing valve with piston according to FIGS. 2 and 3 is replaced by a routing seat valve 62 whose valve member 63 is pressed by means of a spring 64 in the end space 65 against the valve seat 66. The seat valve controls in dependence upon the pressure in the end space 65 the connection between the fluid connection P and the tank connection T. The bypass line 28 in the control valve 10 is omitted, the control piston 310 of said valve having a piston portion 67 by which the connection between the discharge passage 24 and the control passage 44 leading to the end space 65 of the routing valve is controlled.

In the closure position of the routing valve 62 illustrated via the nozzle 68 provided in the valve member 63 the control space 65 is subjected to the pump pressure from the fluid connection P and thus the valve member is pressed into the closure position. If the high pressure in the pump delivery line is to be reduced by adjusting the control piston 310 the fluid path between the control passage 44 via the piston portion 67 to the tank discharge 24 is opened, the end space 65 thereby being relieved of pressure and the valve member 63 moving to the open position in which the desired connection between the fluid connection P and the tank connection T is established. If the control piston 310 returns again to the control position in which the piston portion 67 shuts off the connection to the tank discharge 24, due to the pressure reduction through the nozzle 68 in the end space 65 the routing valve returns to the closure position.

FIG. 5 shows a modified embodiment in which the nozzle 68 is omitted and the pressure buildup in the end space 65 for closing the routing valve 62 takes place via the fluid connection P, the bypass line 28 in the control valve 10 and the piston portion 71 of the control piston 410. If for reducing the high pressure in the pump delivery line the control piston 410 is moved to the left the piston portion 71 shuts off the bypass line 28 and at the same times opens the connection between the control passage 44 and the discharge passage 24 to the tank so that the pressure in the end space 65 is reduced to the tank and the valve member 63 is opened to establish the fluid connection from the connection P to the tank T. After the return of the control piston 410 to the control position via the connection opened by the piston portion 71 between the bypass line 28 and the control passage 44 the end space 65 can again be filled with fluid from the connection P, the routing valve 62 thereby closing.

Compared with FIGS. 2 and 3 the embodiments of FIGS. 4 and 5 are simpler. Instead of the construction of the routing valve as a disc valve preceding the fluid connections to the proportional valve 10 the routing valve can also be provided in a conventional construction which is placed on the control valve 10, the passages 22, 24 and 44 thereof being extended upwardly and opening into the corresponding fluid connections of the routing valve.

I claim:

1. In an electromagnetic control valve for a variable displacement pump having means for varying the displacement of said pump for adjusting the output pressure of said pump in a pump delivery line, said means for varying being responsive to a control pressure in a control pressure line, the control valve being controlled by an electromagnet responsive to the output pressure of said pump for setting a desired pressure in the pump delivery line by selectively communicating said control pressure line with throttled pressure from the pressure side of the variable displacement pump or with a throttled discharge leading to a tank, the improvement comprising further valve means in said control valve moveable from a fully closed to a fully opened position for providing an unthrottled connection between the pump delivery line and the tank and means for moving said further valve means to its fully open position for providing an immediate pressure reduction in the pump delivery line in response to the existance of a pressure in said pump delivery line in excess of a predetermined value.

2. Control valve according to claim 1, for an axial piston pump comprising an adjusting piston as the adjusting means, one side of said piston comprising a control place and the other side of said piston being connected to the pump delivery line and the pressure connection of the control valve.

3. Control valve according to claim 1 wherein the control valve comprises a control valve member movable between a plurality of control positions for throttling a connection between the control prssure line and either the pump delivery line or the tank.

4. Control valve according to claim 1 wherein the control valve further valve means comprises a valve member moveable from a control position through a predetermined travel to a position therein said valve member opens a fluid path between a pressure connection and a tank connection for the pressure reduction in the pump delivery line.

5. Control valve according to claim 4, characterized in that the valve member further comprises a pistong portion for controlling the fluid path between the pressure connection and the tank connection of the control valve.

6. Control valve according to claim 4, characterized in that the electromagnet is a proportional magnet and movement of the valve member for opening the fluid path is effected with a signal which is at least 30% greater than the driving signal necessary for the pressure regulation of the variable displacement pump.

7. Control valve according to claim 6 wherein the signal is about 50% greater than the driving signal.

8. Control valve according to claim 4, characterized in that the valve member comprises a piston portion for controlling the fluid path between the pressure connection and a control passage connected via a throttle means to the tank connection and directly to an auxiliary control space of a routing valve said routing valve being provided for controlling the fluid path between the pressure connection and the tank connection and having a slide piston which is acted upon in one sense by a spring and in the opposite sense by the pressure in said auxiliary control space, said routing valve being switchable by the pressure introduced by said piston portion of the control valve member into the auxiliary control space and for reducing the pressure in the pump delivery line, the pressure connection is connected to the tank connection of the routing valve.

9. Control valve according to claim 8, characterized in that the routing valve is disposed in a valve plate between the control valve and the connections for the lines leading to the pump delivery line, the control space and the tank.

10. Control valve according to claim 8 for an axial piston pump comprising an adjusting piston as the adjusting means, one side of said piston comprising a control space and the other side of said piston being connected to the pump delivery line and the pressure connection of the control valve.

11. Control valve according to claim 4, characterized in that the control valve member comprises a piston portion for controlling the fluid path between the pressure connection and a control passage which is connected to an auxiliary control space of a routing valve, said routing valve being provided for controlling the fluid path between the pressure connection and the tank connection, said routing valve comprising a piston acted upon in one sense by a spring and in the opposite sense by the pressure in said auxiliary control space said piston of said routing valve being displaceable by the pressure introduced by the piston portion in said auxiliary control space to connect the pressure connection of the pump to the tank connection, said control valve member comprising a connecting passage extending between said control passage and the tank connection for connecting in the control position of the control valve member said auxiliary control space of said routing valve to the tank connection.

12. Control valve according to claim 11, characterized in that the routing valve is disposed in a valve plate between the control valve and the connections for the lines leading to the pump delivery line, the control space and the tank.

13. Control valve according to claim 11 for an axial piston pump comprising an adjusting piston as the adjusting means, one side of said piston comprising a control space and the other side of said piston being connected to the pump delivery line and the pressure connection of the control valve.

14. Control valve according to claim 4, characterized in that a routing valve connection is provided between the pressure connection and the tank connection, comprises a seat valve and a cooperating valve member pressed by the pressure in an auxiliary control space into the closure position, and wherein the control valve member includes a piston portion for the pressure reduction, said auxiliary control space being connected to the tank connection for opening said seat valve.

15. Control valve according to claim 14, characterized in that in the valve member a throttle means is provided between the auxiliary control space and the pressure connection.

16. Control valve according to claim 14, characterized in that the control piston of the control valve comprises a piston portion which in the control position of the control valve member connects the auxiliary control space of the routing valve to the pressure connection and by which on being driven in the sense of a pressure reduction in the delivery line of the variable displacement pump the auxiliary control space is connected to the tank connection to open the fluid path from the pressure connection to the tank connection of the routing valve.

17. Control valve according to claim 14, characterized in that the routing valve is disposed contiguous to the housing of the control valve.

18. Control valve according to claim 14, characterized in that the routing valve is disposed in a valve plate between the control valve and the connections for the lines leading to the pump delivery line, the control space and the tank.

19. Control valve according to claim 7 for an axial piston pump comprising an adjusting piston as the adjusting means, one side of said piston comprising a control space and the other side of said piston being connected to the pump delivery line and the pressure connection of the control valve.

* * * * *

UNITED STATES PATENT AND TRADEMARK OFFICE

CERTIFICATE OF CORRECTION

PATENT NO. : 4,699,571

DATED : October 13, 1987

INVENTOR(S) : Reiner Bartholomaus

It is certified that error appears in the above-identified patent and that said Letters Patent is hereby corrected as shown below:

Column 6, line 26, Claim 1, after "discharge" insert --passage--.

Column 6, line 44, Claim 3, "prssure" should be --pressure--.

Column 6, line 54, Claim 5, "pistong" should be --piston--.

Column 8, line 11, Claim 14, after "connection" insert --and--.

Signed and Sealed this

Tenth Day of May, 1988

*Attest:*

*Attesting Officer*

DONALD J. QUIGG

*Commissioner of Patents and Trademarks*